US005353670A

United States Patent [19]

Metzger, Jr.

[11] Patent Number: 5,353,670

[45] Date of Patent: * Oct. 11, 1994

[54] INDEPENDENTLY AND JOINTLY OPERABLE RADIAL SAW GUARDS

[75] Inventor: James I. Metzger, Jr., County of St. Louis, Mo.

[73] Assignee: Emerson Electric Co., St. Louis, Mo.

[ * ] Notice: The portion of the term of this patent subsequent to Feb. 22, 2011 has been disclaimed.

[21] Appl. No.: 38,681

[22] Filed: Mar. 15, 1993

[51] Int. Cl.[5] ..... B27B 5/20; B27G 19/02

[52] U.S. Cl. ..... 83/471.3; 83/478; 83/486.1; 83/DIG. 1; B27B/5/20; B27G/19/02

[58] Field of Search ..... 83/102.1, 471.3, 478, 83/477.1, 486.1, DIG. 1

[56] References Cited

U.S. PATENT DOCUMENTS

| | | | |
|---|---|---|---|
| 2,669,264 | 2/1954 | Wilson | 83/478 |
| 2,926,709 | 3/1960 | Kaley | 83/478 |
| 3,596,033 | 7/1971 | Wickham | 200/168 |
| 3,656,519 | 4/1972 | Stackhouse | 83/102.1 |
| 3,880,032 | 4/1975 | Green | 83/102 |
| 3,884,101 | 5/1975 | Silkin | 83/544 |
| 3,913,437 | 10/1975 | Speer et al. | 83/478 |
| 4,043,237 | 8/1977 | Pyle | 83/478 |
| 4,150,598 | 4/1979 | Berends et al. | 83/478 |
| 4,176,571 | 12/1979 | Batson | 83/397 |
| 4,532,841 | 8/1985 | Stackhouse, Jr. | 83/102.1 |
| 4,553,462 | 11/1985 | Silken | 83/471.3 |
| 4,958,544 | 10/1990 | Miyamoto | 83/471.3 |
| 5,199,343 | 4/1993 | O'Banion | 83/397 |

*Primary Examiner*—Hien H. Phan

*Attorney, Agent, or Firm*—Polster, Lieder, Woodruff & Lucchesi

[57] ABSTRACT

A radial saw with independently and jointly operable saw blade guards is disclosed. The independently and jointly operable saw blade guards include an upper blade guard mounted in fixed position relative to a yoke that depends from a supporting arm, the upper blade guard covering at least approximately an upper half of a motor driven saw blade that is mounted on the yoke. A lower rear blade guard is pivotally mounted to the upper blade guard and is configured to cover a lower half rear area on at least one side of the motor driven saw blade, and a lower front blade guard is independently pivotally mounted to the upper blade guard and configured to cover a lower front half area on at least one side of the motor driven saw blade guard. The lower rear blade guard and lower front blade guard are independently and jointly operable and telescopically movable with respect to one another.

18 Claims, 8 Drawing Sheets

INDEPENDENTLY AND JOINTLY OPERABLE RADIAL SAW GUARDS

CROSS REFERENCE TO RELATED APPLICATIONS

This is a copending application to Ser. No. 08/031,334 dated Mar. 15, 1993 entitled RADIAL SAW SAFETY GUARDS AND BARRIERS, now U.S. Pat. No. 5,287,779, and Ser. No. 08/031,345 dated Mar. 15, 1993 entitled RADIAL ARM SAW GUARD WITH OPERATIONAL INTERLOCK, now U.S. Pat. No. 5,287,780.

BACKGROUND OF THE INVENTION

The present invention relates to independently and jointly operable blade guards for a radial saw, and more particularly, to a fixed upper guard and independently and jointly operable lower rear and front guards that are telescopically movable with respect to one another in order to provide substantial protection to a user through limited exposure to a motor driven saw blade.

Typically, a radial saw is mounted on a supporting arm that overhangs a worktable. The supporting arm is mounted at an upper end of a base or column that extends upwardly from one end of a worktable. A motor driven saw blade is pivotally and slidably mounted to the supporting arm for operating the motor driven saw blade in rip cutting workpieces longitudinally along the length of a rip fence or for cross cutting of workpieces transverse to the rip fence.

Because the radial saw is operated in fixed and moving relationship in two different directions for rip cutting and cross cutting, different safety hazards can arise from improper use of the radial saw. In order to fully appreciate the nature of the safety hazards involved in rip cutting and cross cutting, it is important to understand the nature of the rip cutting and cross cutting operations. Rip cutting involves the changing of the width of a workpiece by cutting along its length. The workpiece is fed into the motor driven saw blade, which rotates in a fixed position, parallel to a rip fence, and at a set distance from the rip fence, enabling the fence to serve as a guide for the workpiece to be cut. Cross cutting, on the other hand, is cutting a workpiece to length. The workpiece is held firmly against the workpiece fence, and the blade is pulled through the workpiece to make the cut. Straight, bevel, miter and compound cuts can be made.

The safety hazards associated with rip cutting include outfeed zone hazard, kickback and wrong way feeding. If the operator reaches around the blade to the outfeed side and tries to hold or pull the workpiece through, the rotational force of the blade can pull the hand back into the blade. Therefore, touching, holding or pulling on the outfeed of a workpiece, while the blade is still spinning, can result in fingers, hand or an arm being cut off. Kickback occurs when a blade is pinched or bound by a workpiece. This can result in the work being thrown out of the radial saw in the direction of a user causing personal injury. Wrong way feed is an attempt to feed the workpiece into the outfeed side of the blade. Rotational force can pull the workpiece into the blade if the workpiece is fed in the same direction as the blade rotates. As a result, hands and fingers could be pulled along with the workpiece into the spinning blade before the user can let go or pull back. Not only can fingers, hand or an arm be cut off, but a propelled workpiece could injure a bystander.

Cross cutting safety hazards include exposed blade teeth, rolling carriage and thrown workpiece. During cross cutting, blade teeth can be exposed which if contacted can result in potential damage to the fingers, hand or arm of a user. Rolling carriage hazard occurs when the spinning blade inadvertently touches a workpiece or is lowered into the table causing the blade to suddenly come forward. This creates a risk to the user whose hands may be in the path of the blade. Finally, thrown workpiece hazard occurs when a workpiece is picked up by a spinning blade and thrown. A user or bystander could be hit by the thrown workpiece.

As will be understood from the discussion that follows, the present invention employs numerous safety and operational features in a radial saw which overcome many of the rip cutting and cross cutting hazards to which a user can be exposed through improper operation of the saw. As a result, the difference of the present invention from prior art designs will be readily apparent to those skilled in the art.

In copending patent application Ser. No. 08/031,344 filed Mar. 15, 1993 entitled RADIAL SAW SAFETY GUARDS AND BARRIERS, now U.S. Pat. No. 5,287,779, the disclosed radial saw incorporates blade guards and barriers to enhance the safety and operation in the radial saw. In the aforementioned copending patent application, link arms were employed between an upper fixed guard and a lower movable guard in order to provide movement or lack of movement between the guards, for rip cutting and cross cutting purposes. The present invention employs an upper fixed blade guard, with lower front and rear independently and jointly operable and telescopically mounted guards which are movable with respect to one another and to the upper fixed blade guard, in order to limit the exposure to a motor driven saw blade, while affording substantial protection to a user. In conjunction with such independently and jointly operable guards, adjustable infeed and outfeed user barriers and workpiece engaging elements are also employed to enhance the safety and operation of the radial saw during rip cutting and cross cutting.

SUMMARY OF THE INVENTION

Among the several objects and advantages of the present invention include:

The provision of new and improved independently and jointly operable saw guards for a radial saw;

The provision of the aforementioned independently and jointly operable saw guards including a fixed upper blade guard and lower front and rear blade guards which are independently and jointly operable and telescopically mounted with respect to one another and to the fixed upper blade guard;

The provision of a lower rear blade guard that is pivotally mounted to the fixed upper blade guard and configured to cover a lower half rear area of a motor driven saw blade;

The provision of a lower front blade guard independently and pivotally mounted to the upper blade guard at a pivot point spaced from or at the same location as the lower rear blade guard and configured to cover a lower half front area of a motor driven saw blade.

The provision of a wrong way feed barrier for the lower rear blade guard during rip cutting;

The provision of a curved shape along an infeed end of the lower front blade guard to facilitate automatic upward and downward movement of the lower front blade guard upon engaging or disengaging a workpiece;

The provision of the aforementioned independently and jointly operable saw guards which include a simplified structure with a minimum number of parts, are easy to operate, are durable and long lasting in construction, incorporate easy to understand user friendly designs, and are otherwise well adapted for the purposes intended.

Briefly stated, the present invention discloses a radial saw for rip cutting and cross cutting that includes a motor driven saw blade mounted on a yoke depending from a supporting arm the overhangs a worktable. The motor driven saw blade is movable relative to a worktable mounted fence to enable the motor driven saw blade to be operated for rip cutting of workpieces longitudinally relative to the fence or for cross cutting transverse relative to the fence. An upper blade guard is mounted in fixed position relative to a motor that is mounted in a yoke for covering at least approximately an upper half of the motor driven saw blade. The motor, motor driven saw blade and upper blade guard are movable relative to the yoke for bevel cuts. A lower rear blade guard is pivotally mounted to the upper blade guard and configured to cover a lower half rear area on at least one side of the motor driven saw blade. A lower front blade guard is independently pivotally mounted to the upper blade guard and is configured to cover a lower half front area on at least one side of the motor driven saw blade.

The lower rear blade guard and lower front blade guard are independently and jointly operable and telescopically movable with respect to one another to provide substantial protection to a user through limited exposure to the motor driven saw blade. The lower rear blade guard is also telescopically movable relative to the upper blade guard when the lower rear blade guard is lifted at the start of cross cutting and also when the workpiece lifts the guards for rip cuts. The lower rear blade guard and the lower front blade guard are jointly pivotally mounted to the upper blade guard and include cooperating complementary pin and slot means spaced from the joint pivotal mounting of the lower rear blade guard and lower front blade guard to facilitate telescopic movement with respect to one another.

The lower rear blade guard is a U-shaped element that extends on opposite sides of and across an outfeed end of the motor driven saw blade. The lower front blade guard may comprise a flat plate section on one side of the motor driven saw blade or a pair of opposed flat blade sections mounted on opposite sides of the motor driven saw blade.

The lower rear blade guard includes a wrong way feed barrier during rip cutting. The wrong way feed barrier includes a blunt transverse wall along an outfeed end of the lower rear blade guard. The blunt transverse wall cooperates with the pivotal mounting of the lower rear blade guard to the upper fixed blade guard to provide the wrong way feed barrier during rip cutting. The blunt transverse wall helps to prevent hand entry into the rip outfeed end of the motor driven saw blade when a rip cut is in progress and the lower rear blade guard rests on a workpiece. If the tiring knife and anti-kickback pawls are not used, the blunt transverse wall serves as an important back-up to prevent hand entry.

The lower rear blade guard includes an angularly wall section that extends upwardly and outwardly from the blunt transverse wall and terminates in an inclined upper wall section that overlies the upper blade guard. Means are provided for lifting the lower blade guard relative to the upper blade guard at the start of cross cutting. Such means include a hand operated trigger means connected to the lower rear blade guard for raising same. The lower front blade guard includes a curved shape along an infeed end which cooperates with the joint pivotal and telescopic mounting of the lower rear blade guard and lower front blade guard to each other to facilitate independent and joint automatic upward or downward movement of the lower front blade guard and lower rear blade guard upon engaging or disengaging a workpiece.

The U-shaped lower rear blade guard includes a blunt transverse wall at an upper angular wall section forming a bight end portion of the U-shaped lower rear blade guard for covering blade tip ends of the motor driven saw blade. General parallel and opposed triangular shaped side plates extend from the bight end portion for covering opposite sides of the motor driven saw blade. The triangular shaped plates of the U-shaped lower rear blade guard are pivotally mounted to the upper blade guard at a location spaced from the bight end portion of the U-shaped lower rear blade guard.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives and uses of the invention, including what I presently believe is the best mode of carrying out the invention.

Figure 1:
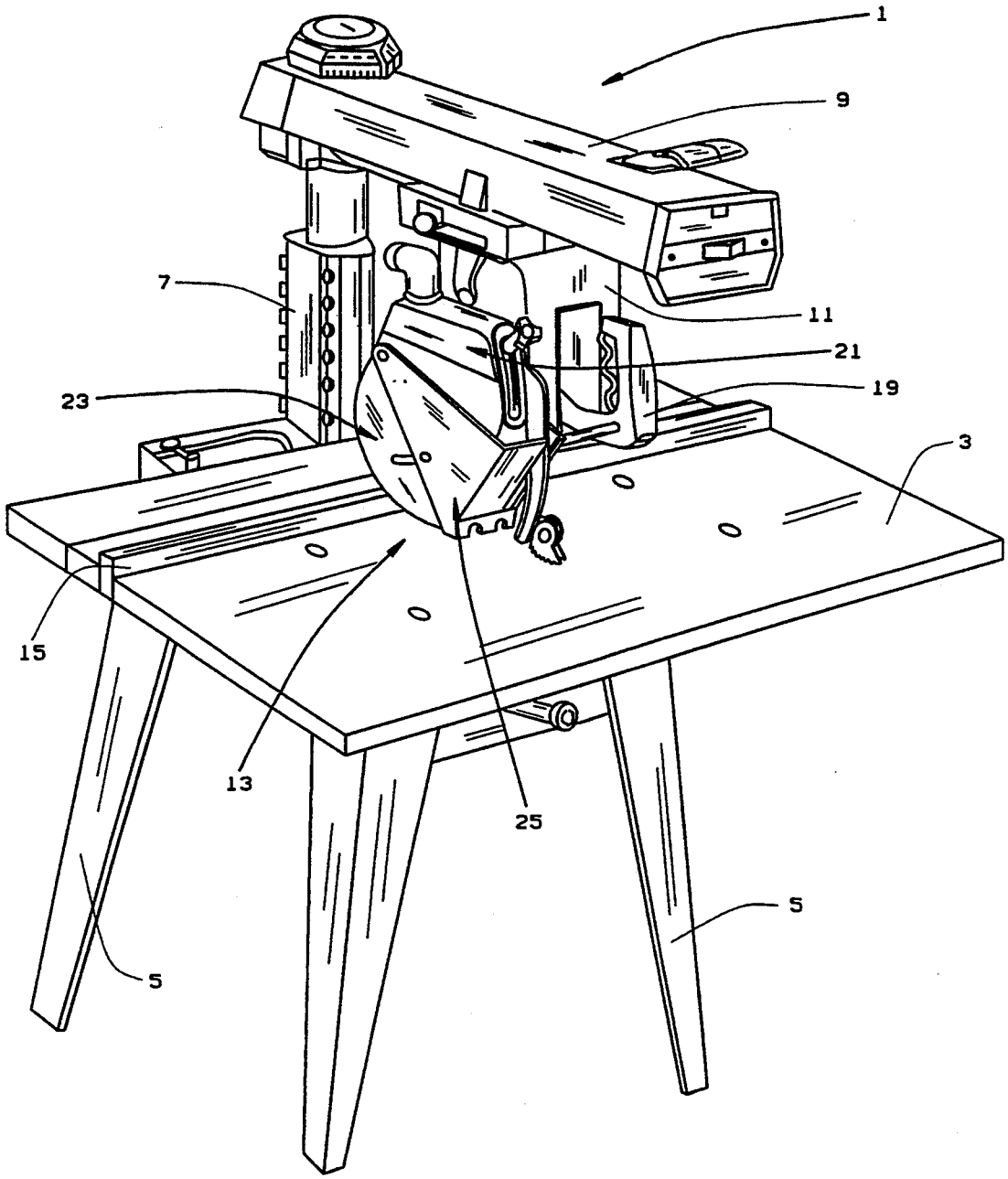
FIG. 1 is an enlarged perspective view of a radial saw employing independently operable saw guards which are constructed in accordance with the teachings of the present invention.

As illustrated in the drawings, the radial saw 1 includes a horizontally extending worktable 3 which is supported by a plurality of legs 5, as is typical. A base or column 7 extends upwardly from one side of the worktable 3 for supporting along one end thereof a supporting arm 9 which overhangs the worktable 3. A yoke 11 depends from supporting arm 9 and rotatably and slidably mounts the radial arm assembly 13, for moving the radial saw assembly 13 into rip cutting or cross cutting relationship relative to a worktable mounted fence 15. A worktable mounted fence 15 can be mounted in the front fence position as illustrated in FIG. 1 of the drawings or in a rear fence position (not shown) where the worktable mounted fence 15 is located adjacent the base or column 7 at one side of the worktable 3 or in a third position between the front and rear positions where the fence 13 is positioned between the rearmost and second of the three sections shown of the worktable 3.

The manner in which the yoke 11 is rotatably mounted to the supporting arm 9 can be best understood by reference to copending application Ser. No. 08/031,345 filed Mar. 15, 1993 entitled RADIAL AIM SAW GUARD WITH OPERATIONAL INTERLOCK, now U.S. Pat. No. 5,287,780. There are a number of ways in which the yoke can be rotatably mounted to the supporting arm 9, all of which are within the purview of the present invention, but none of which are specifically important in understanding the independently and jointly operable front and rear blade guards in the radial saw of the present invention.

Figure 2:
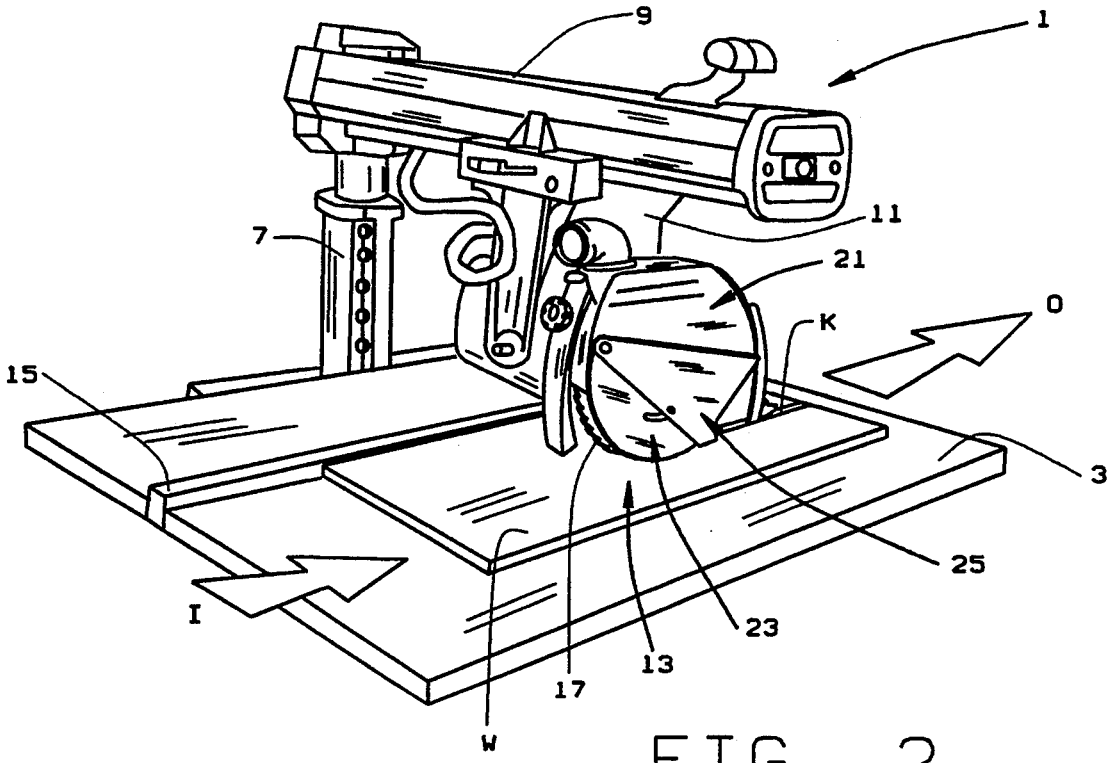
FIG. 2 is a slightly reduced in size perspective view of the radial saw shown in FIG. 1, without the table legs, when viewed along an infeed side in a rip cutting operation.

When it is desired to operate the radial saw assembly 13 in a rip cutting operation, the radial saw assembly 13 is positioned relative to the worktable mounted fence 15 as shown in FIG. 2 of the drawings, in order to enable a motor driven saw blade 17 to rip cut workpieces longitudinally along the length of the worktable mounted fence 13. In this manner, the width of the workpiece W will be reduced by cutting along its length. It will be noted that while FIGS. 2–3 depict an "out rip" set-up, an "in rip" set-up may also be used by rotating the motor driven saw blade, upper blade guard and motor 180° for an "in rip" rip cutting arrangement.

Figure 4:
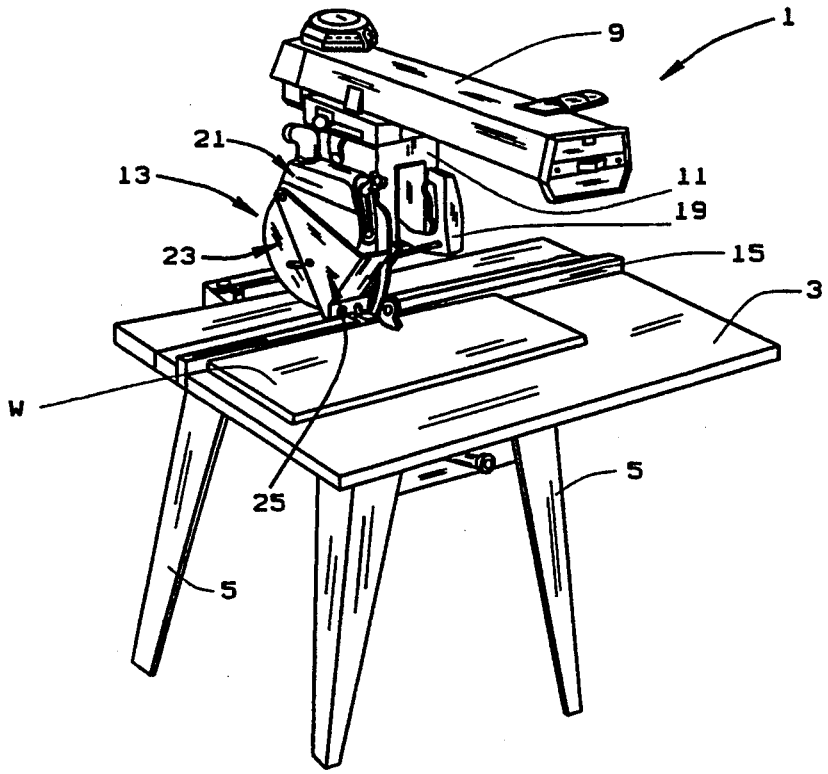
FIG. 4 is a similar reduced size perspective view of the radial saw shown in FIG. 1, just prior to operating same in a cross cutting operation.
Figure 5:
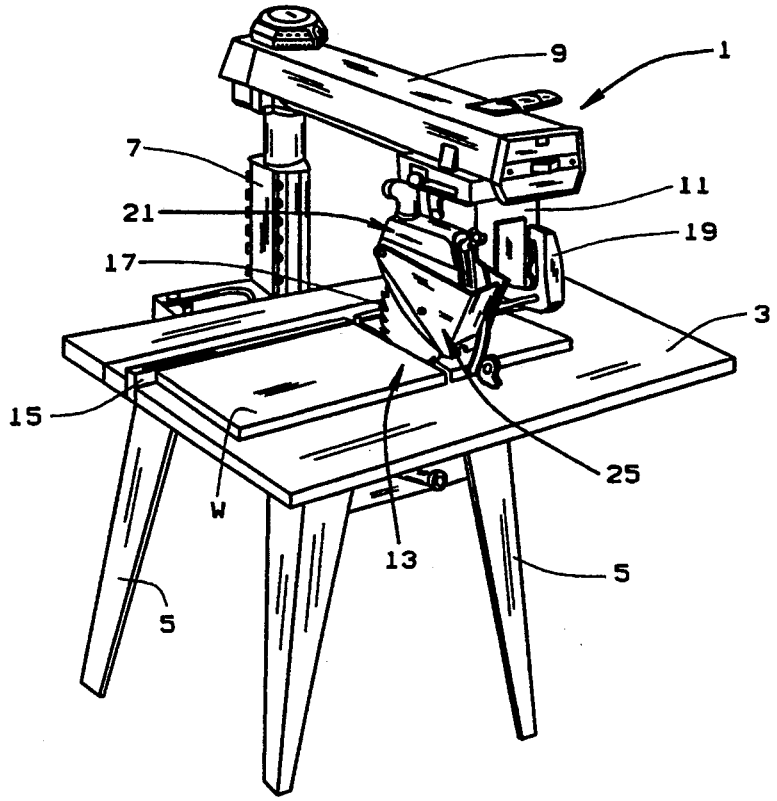
FIG. 5 is also a similar reduced in size perspective view of the radial saw shown in FIG. 1 when operated in a cross cutting operation.
Figure 6:
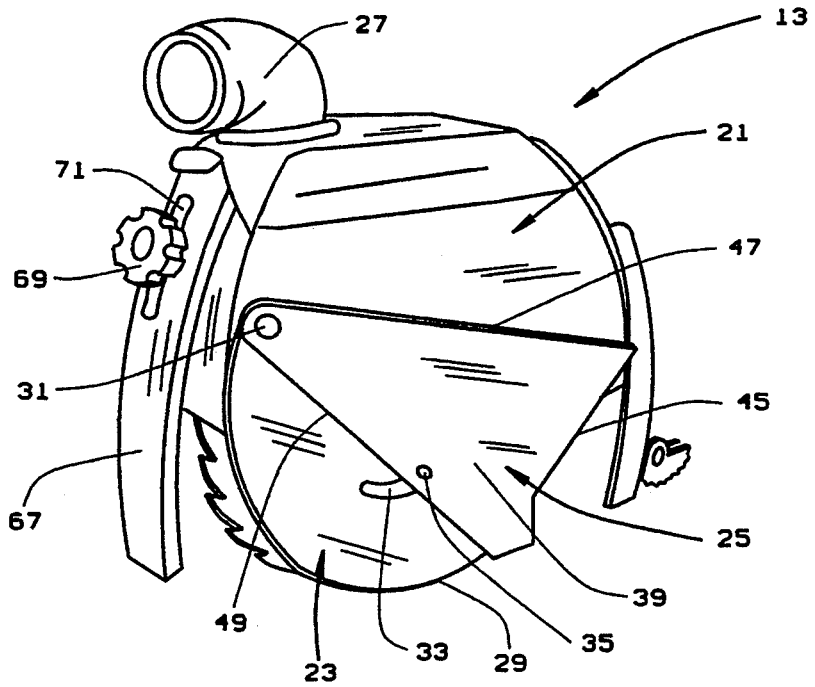
FIG. 6 is an enlarged perspective view of the radial saw assembly including the independently operable saw guards, as viewed from an infeed side when set up for a rip cutting operation.

When it is desired to perform a cross cutting operation, the radial saw assembly 13 is positioned, as illustrated in FIGS. 4–5 of the drawings, to enable the motor driven saw blade to cross cut a workpiece W transverse to the worktable mounted fence 15, for cutting a workpiece to length.

In order to fully understand the independently and jointly operable lower front and rear blade guards in the radial saw of the present invention, attention is first directed to FIGS. 2–5 of the drawings for a general description of rip cutting and cross cutting operations.

Figure 3:
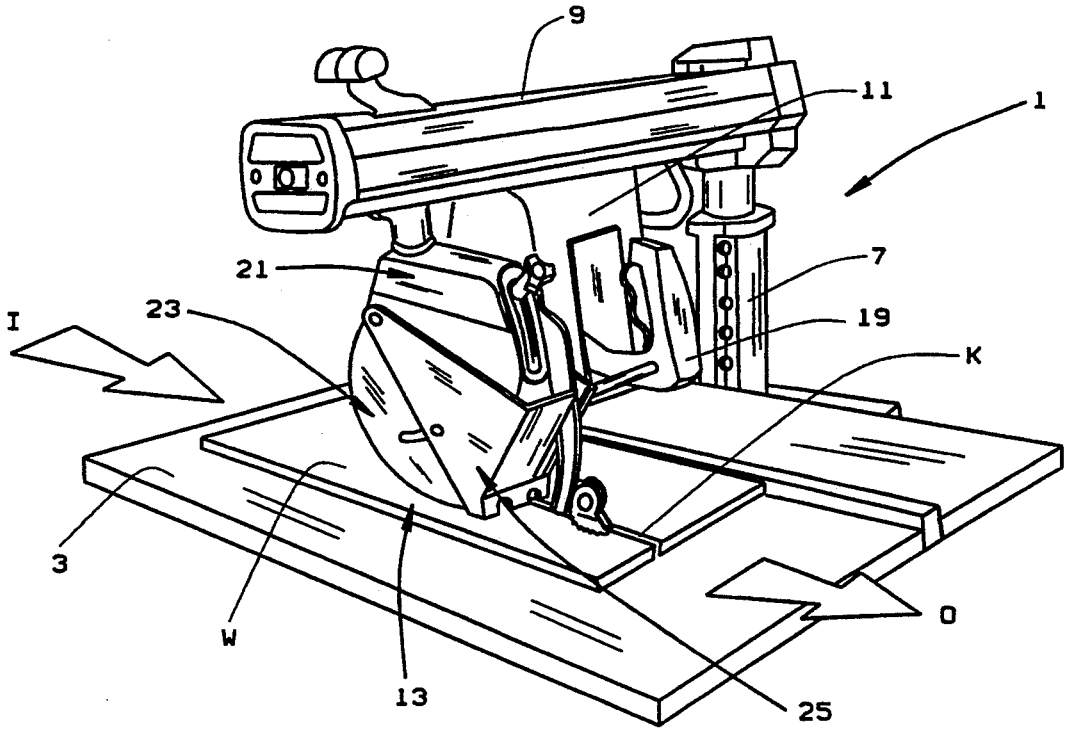
FIG. 3 is also a similar reduced in size perspective view of the radial saw of FIG. 1, also without the table legs, as viewed on an outfeed side in a rip cutting operation.

As shown in FIGS. 2–3 of the drawings, rip cutting involves changing the width of a workpiece by cutting along its length. In FIG. 2, the workpiece W is fed along the infeed side I into the radial saw assembly 13, which is mounted in a fixed position relative to the supporting arm 9, for rip cutting workpieces W longitudinally along the length of the worktable rip fence 15. In a rip cutting operation, the motor driven saw blade 17 rotates in a fixed position parallel to the worktable rip fence 15 at in a set distance from the rip fence 15. Thus, when a workpiece W is fed into the fixed motor driven saw blade 17, the rip fence 15 serves as a guide for the workpiece W to be cut. On the outfeed side O of the radial saw assembly 13, a workpiece kerf K is formed behind the motor driven saw blade 17. Suitable outfeed user barrier means, in the form of a riving knife and anti-kickback pawls, are employed to extend within and on both sides of the workpiece kerf K for the safety and enhanced operation of the radial saw assembly during the rip cutting operation, as will be subsequently discussed.

FIGS. 4–5 of the drawings illustrates a cross cutting operation. Prior to the start of the cross cutting operation, the lower rear blade guard 25 and the lower front blade guard 23 must be moved upwardly and over the worktable supported fence 15 from the position illustrated in FIG. 4 to that illustrated in FIG. 5 of the drawings. For this purpose, a hand operated trigger mechanism (see FIGS. 14–15) is associated with a handle 19 that is pulled by the user to move the blade 17 through the workpiece W to make the complete cut, as shown in FIG. 5 of the drawings. It will be noted that the radial saw assembly 13, in FIGS. 4–5 of the drawings, is shown in a direction transverse to the worktable mounted fence 15, in order to cut a workpiece W to the suitable length. Also to be explained below will be the manner in which the trigger mechanism engages and lifts the independently and jointly operable lower front and rear blade guards, at the start of the cross cutting operation, as explained above.

Referring now to the specific details of the independently and jointly operable lower front and rear blade guards in the radial saw assembly 13 of the present invention, attention is focused on FIGS. 6–15 which shows the independently and jointly operable guards in a radial saw assembly 13 during rip cutting and cross cutting operations.

The radial saw assembly 13 includes a fixed upper blade guard 21, a lower front blade guard 23 and a lower rear blade guard 25. The specific construction and operation of the fixed upper blade guard 21, the lower front blade guard 23 and the lower rear blade guard 25 will now be described in detail.

The upper blade guard 21 is mounted in fixed position relative to the yoke mounted motor driven saw blade 17 for covering at least approximately an upper half of the motor driven saw blade 17. Specifically, the upper blade guard 21 is mounted to a motor (not shown) supported by the yoke 11, in any suitable manner. One way of achieving this is to use a guard clamp screw and clamp pawl disclosed in copending patent application Ser. No. 08/031,344 filed Mar. 15, 1993 entitled RADIAL SAW SAFETY GUARDS AND BARRIERS, now U.S. Pat. No. 5,287,779.

The upper blade guard 21 includes an exhaust port 27 for the removal of saw dust. Together with the lower front and rear blade guards and adjustable infeed and outfeed user barriers, described in detail below, the motor driven saw blade 17 is essentially surrounded during rip cutting and cross cutting operations. Thus, sawdust is directed into the upper blade guard 21 for exhaust through the exhaust port 27. By covering approximately the upper half of the motor driven saw blade 17, the upper blade guard 21 has several important functions. These include preventing any hand contact with the upper half of the motor driven saw blade 17, while enabling sawdust to be directed out of the saw dust outlet 27. The upper blade guard 21 also provides a mounting means for the lower front and rear blade guards 23, 25, respectively, and other barrier components, to be subsequently described.

Both the lower front and rear blade guards 23, 25, respectively, are shown as being pivotally mounted to the upper blade guard at 31 preferably for joint pivotal mounting and telescopic movement with respect to one another. It will also be understood that the lower front and rear blade guards 23, 25 can be pivotally mounted to each other at spaced pivot points as well, if desired. The lower front blade guard 23 preferably is in the shape of a flat plate section of half-moon shape, which is desirably formed from transparent plastic material, to permit easy visibility of the motor driven saw blade 17. As will be seen throughout the various figures of the drawings, the lower edge 29 of the lower front blade guard has a curvilinear or curved shape, for purposes which will be presently discussed.

As illustrated, the lower front blade guard 23 and the lower rear blade guard 25 are jointly pivotally mounted to the upper blade guard 21 at pivot point 31, thus requiring any upward or downward movement of the lower front blade guard 23 or lower rear blade guard 25 to be about the joint pivot axis 31. Spaced from the joint pivot axis 31 is a complementary slot and pin 33, 35 formed in the lower front blade guard 23 and lower rear blade guard 25, respectively, to partially limit the extent of movement of the lower front blade guard 23 and lower rear blade guard 25 relative to one another.

It will be noted that the lower rear blade guard 25 is a U-shaped element having a bight end portion 37 which generally overlies the blade tip ends of the motor driven saw blade 17 and a pair of generally parallel and opposed triangular shaped side plates 39, 39 which extend from the bight end portion 37 for covering opposite sides of the motor driven saw blade 17. At the bottom end of the bight end portion 37, a blunt transverse wall 41 is provided to provide a wrong way feed barrier during rip cutting, as will be subsequently explained. A series of notches 43 are formed at the lower edge of the blunt transverse wall 41 to enable corners of workpieces W to clear the lower rear blade guard 25 during bevel rip cuts near the edge of a workpiece W. Extending upwardly from the blunt transverse wall 41 is an upper angular wall section 45 which extends upwardly and outwardly away from the blunt transverse wall 41 and terminates in an inclined upper wall section 47 that overlies the upper blade guard 21. A lower inclined edge or wall section 49 overlies the flat plate section forming the lower front blade guard 23, as illustrated in the drawings. Thus, the angular wall section 37 and upper and lower inclined edges 47, 49 form the generally triangular shaped side plate that overlies both the upper blade guard 21 and the lower front blade guard 23.

In order to understand the safety and operational features incorporated in the independently and jointly operable lower front blade guard and lower rear blade guard 23, 25, respectively, it will be helpful to understand how those features are employed during rip cutting and cross cutting operations.

Figure 12:
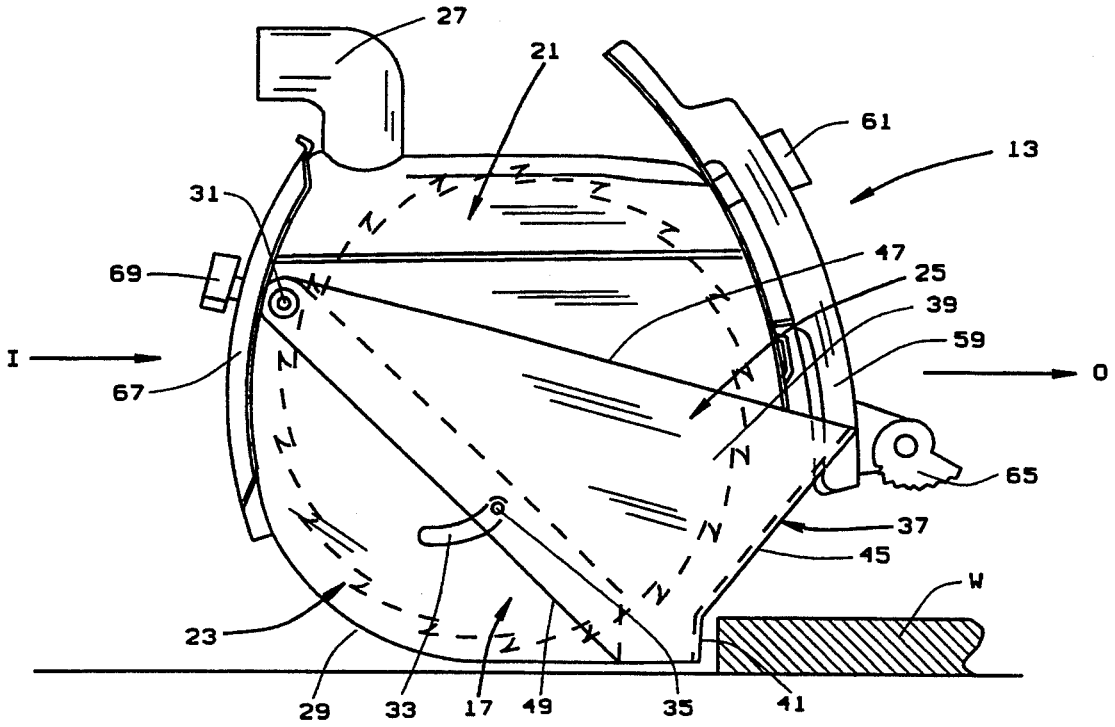
FIG. 12 is a side elevational view of the radial saw assembly and particularly illustrating a wrong way infeed barrier incorporated in the lower rear blade guard.

In rip cutting, the lower rear blade guard 25 is provided with a wrong way feed barrier in the form of the blunt transverse wall 41. The blunt transverse wall 41 prevents workpiece entry from the outfeed end O, as best shown in FIG. 12 of the drawings. Thus, it is impossible for a user to insert a workpiece W into the radial saw assembly 13 since the blunt transverse wall 41, cooperating with the pivotal mounting of the lower rear blade guard 25 to the upper blade guard 21, prevents workpiece entry into the radial saw assembly 13 from the outfeed end O during rip cutting. As will be appreciated, the pivotal mounting of the lower rear blade guard 25 to the upper blade guard 21 at the pivot axis 31, together with the presence of the worktable 3, prevents rotation of the lower rear blade guard 25 in a counterclockwise direction. Thus, it will be impossible to lift the lower rear blade guard 25 when an attempt is made to insert a workpiece into the outfeed end of the radial saw assembly 13 during a rip cutting operation.

Along an infeed end I of the lower front blade guard 23, the curvilinear or curved edge 29 cooperates with the pivotal mounting of the lower front blade guard 23 to the upper blade guard 21 at the pivot axis 31, in order to facilitate automatic upward and downward movement of the lower front blade guard 23 relative to the upper blade guard 21. Thus, as a workpiece is properly inserted into the infeed end I of the radial saw assembly 13, as shown in FIGS. 8–11 of the drawings, the lower front blade guard 23 will automatically move upwardly relative to the fixed upper blade guard 21, allowing the lower front blade guard 23 to rest upon workpieces of different thickness, while protecting a user against contact with the sides of the motor driven saw blade 17. The lower front blade guard 23 is arranged to automatically move upwardly and downwardly relative to the upper fixed blade guard 21 by riding on the surface of a workpiece W during rip cuts.

Because the lower front blade guard 23 and lower rear blade guard 25 are jointly or otherwise pivoted together to the upper blade guard 21 at pivot axis 31 and also have the complementary slot and pin connection 33, 35 spaced from the pivot axis 31, the lower front blade guard 23 and lower rear blade guard 25 are both jointly and independently movable, as well as being telescopically mounted with respect to one another. The lower rear blade guard 25 is independently movable, when there is an attempt to wrong way feed a workpiece W from the outfeed end O during a rip cutting operation, as shown in FIG. 12 of the drawings. The blunt transverse wall 41 will engage the workpiece W, and due to the construction, weight, and pivotal mounting of the lower rear blade guard 25 to the upper blade guard 21 at 31, it is impossible for a workpiece W to enter the radial saw assembly 13 from the outfeed side O during rip cutting. In this regard, the lower rear blade guard 25 operates independently from the lower front blade guard 23. At the same time, the lower rear blade guard 25 cooperates with the upper fixed blade guard 21 in covering the motor driven saw blade 17 to prevent hand contact at the outfeed side O of the radial saw assembly 13 during rip cuts. If the riving knife and anti-kickback pawls are not used, the blunt transverse end wall serves as an important back-up to prevent hand entry.

Figure 8:
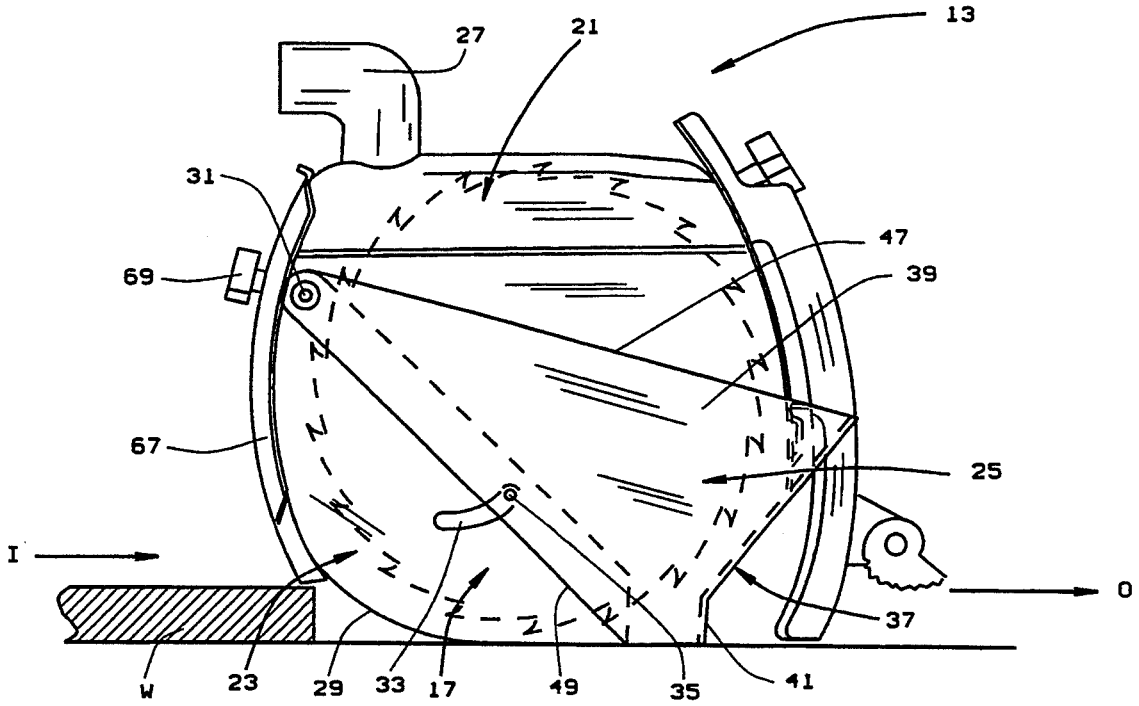
FIG. 8 is an enlarged size elevational view of the radial saw assembly including independently operable saw guards, just prior to a rip cutting operation.
Figure 9:
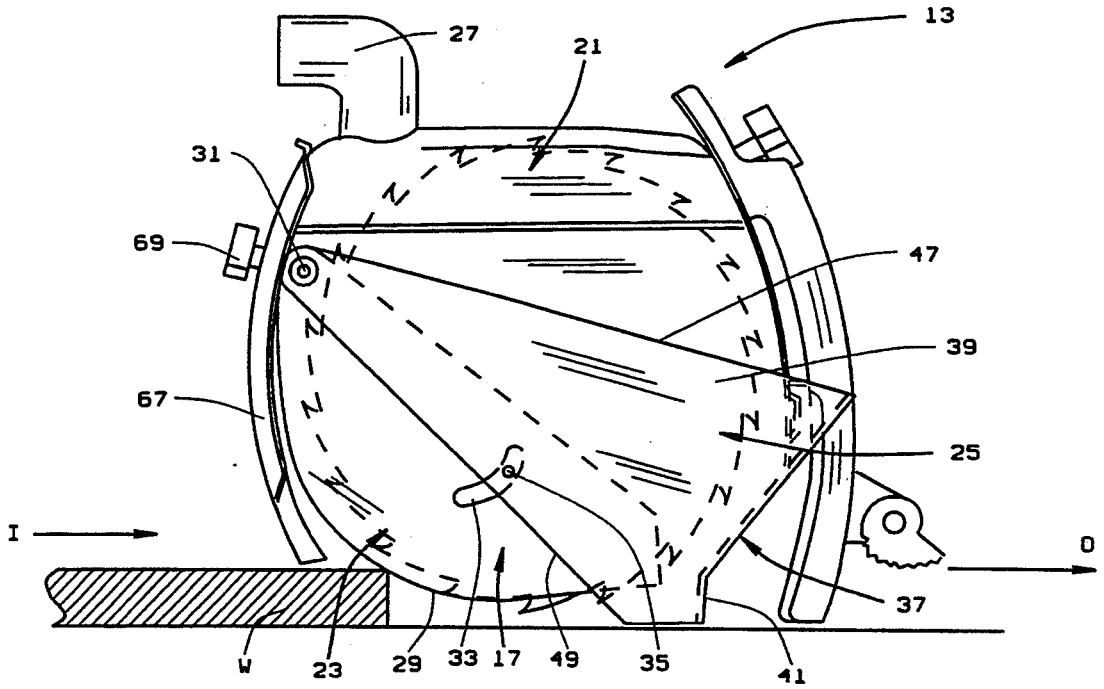
FIG. 9 is a side elevational view similar to FIG. 8 and illustrating a radial saw assembly including independently operable saw guards at the beginning of a rip cutting operation.
Figure 10:
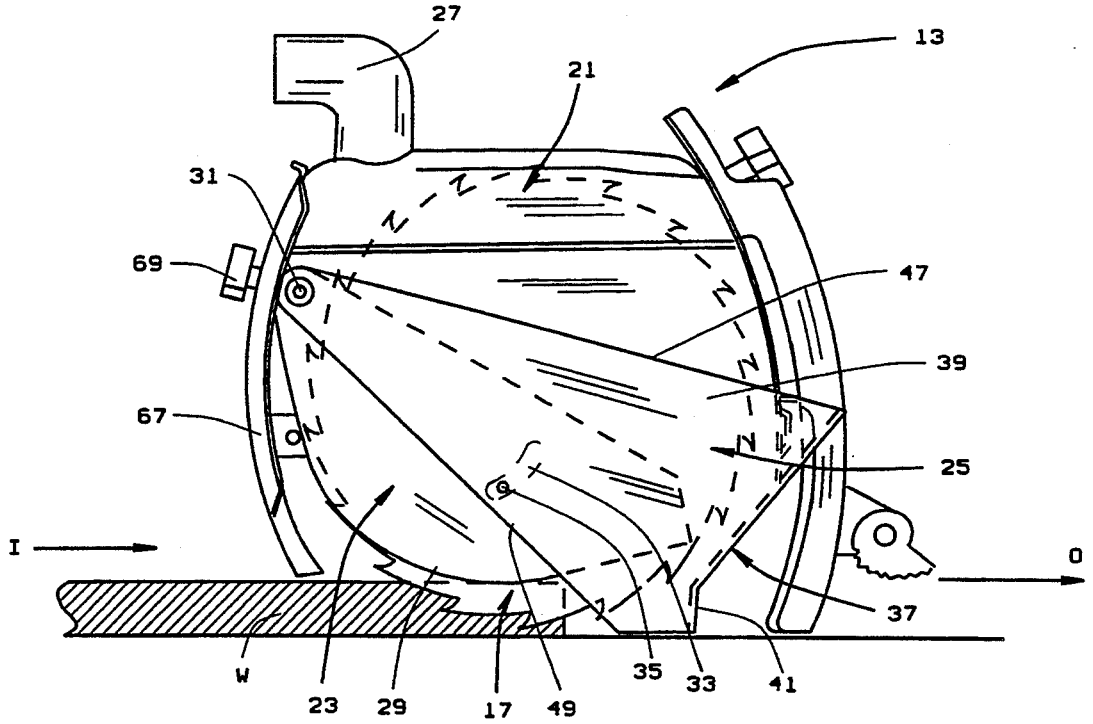
FIG. 10 is an enlarged side elevational view similar to FIGS. 8 and 9, and illustrating how a lower front blade guard is moved upwardly to expose a motor driven saw blade during a rip cutting operation.
Figure 11:
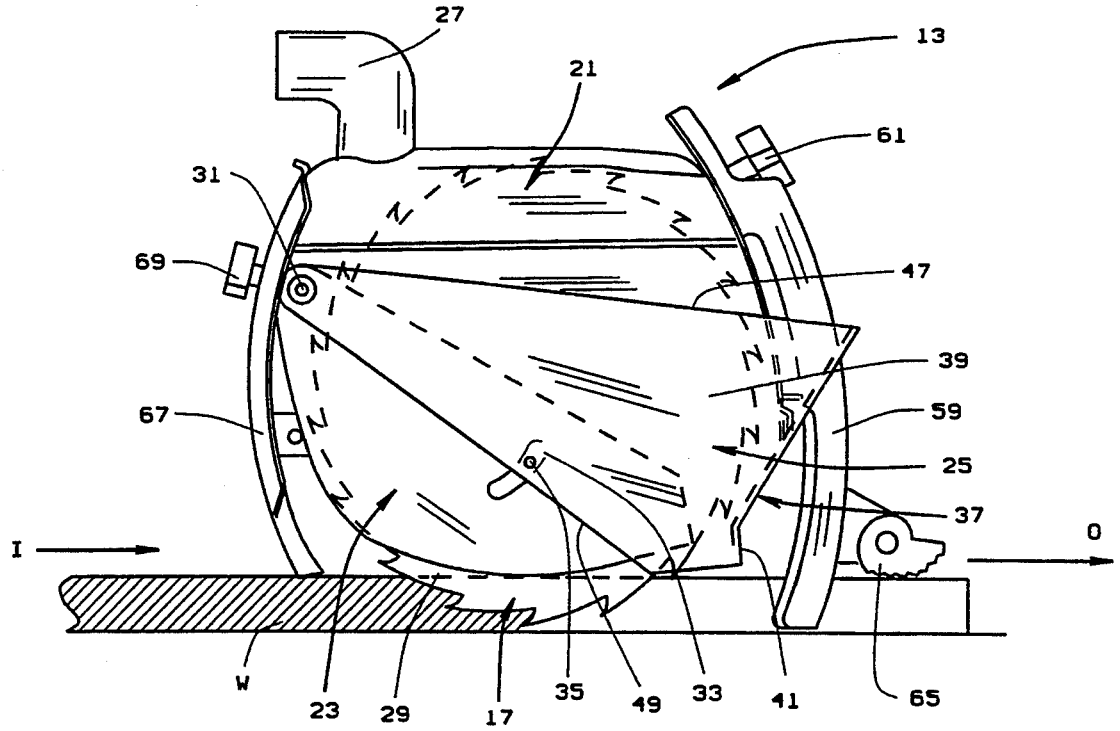
FIG. 11 is a similar enlarged side elevational view of the radial saw assembly during a rip cutting operation and showing the manner in which the independently and jointly operable lower front and rear saw guards are moved upwardly relative to a workpiece in order to expose a motor driven saw blade, in conjunction with an adjustable hold down and riving knife which are used during rip cutting operations.

The lower front blade guard 23 also operates independently of the lower rear blade guard 25 to the extent permitted by the length of the curvilinear slot 33 in the lower front blade guard 23. Reference to FIGS. 8–11 will show this initial independent movement. In FIG. 8 of the drawings, the workpiece W is shown spaced from the radial saw assembly 13, prior to engaging the lower curved or curvilinear edge 29 of the lower front blade guard 23. In FIG. 9 of the drawings, the workpiece W has engaged the lower curvilinear edge 29 of the lower front blade guard 23 and begins to automatically lift the lower front blade guard 23 by moving same about the pivot axis 31. In FIG. 10 of the drawings, the lower front blade guard 23 is moved up the entire length of the curvilinear slot 33, by the pivoting movement of the lower front blade guard 23 about the pivot axis 31. FIG. 11 shows the bottom of the curvilinear slot 33 engaging the pin 35 of the lower rear blade guard 25 and lifting the entire rear blade guard 25, upon upward movement of the lower front blade guard 23. At this point, the lower front blade guard 23 and lower rear blade guard 25 are jointly pivoting together about the pivot axis 31, with the complementary slot and pin 33, 35 assisting in lifting the lower rear blade guard 25, as the lower front blade guard 23 is moved upwardly beyond the length of the curvilinear slot 33.

The angled lower edges on the sides 39 of the lower rear blade guard 25 also serve to raise the lower rear blade gaurd 25 on thinner workpieces where the slot 33 on the lower front blade guard doesn't yet lift the pin 35 on the lower rear blade guard 25. Ideally, the slot 33 should be long enough so that the lower front blade guard 23 never lifts the lower rear blade guard for normal workpiece thicknesses. The lower rear blade gaurd 25 will lift itself when contacted by the workpiece. However, when the lower rear blade guard 25 is lifted for cross cut, as by a trigger, the pin 25 will lift the lower front blade guard 23 high enough to clear the fence and workpiece or, on thicker workpieces, high enough so that the geometry of the lower front blade guard 23 (pivot 31 and edge 29) permit the workpiece to further lift the lower front blade guard 23 as it rides over the workpiece.

Since the triangular plates 39 of the U-shaped lower rear guard 25 extend on both sides of the motor driven saw blade 17, the lower front blade guard 23 may be mounted on one or both sides of the motor driven saw blade 17 to the lower rear blade guard 25, in the same manner as explained above.

Figure 13:
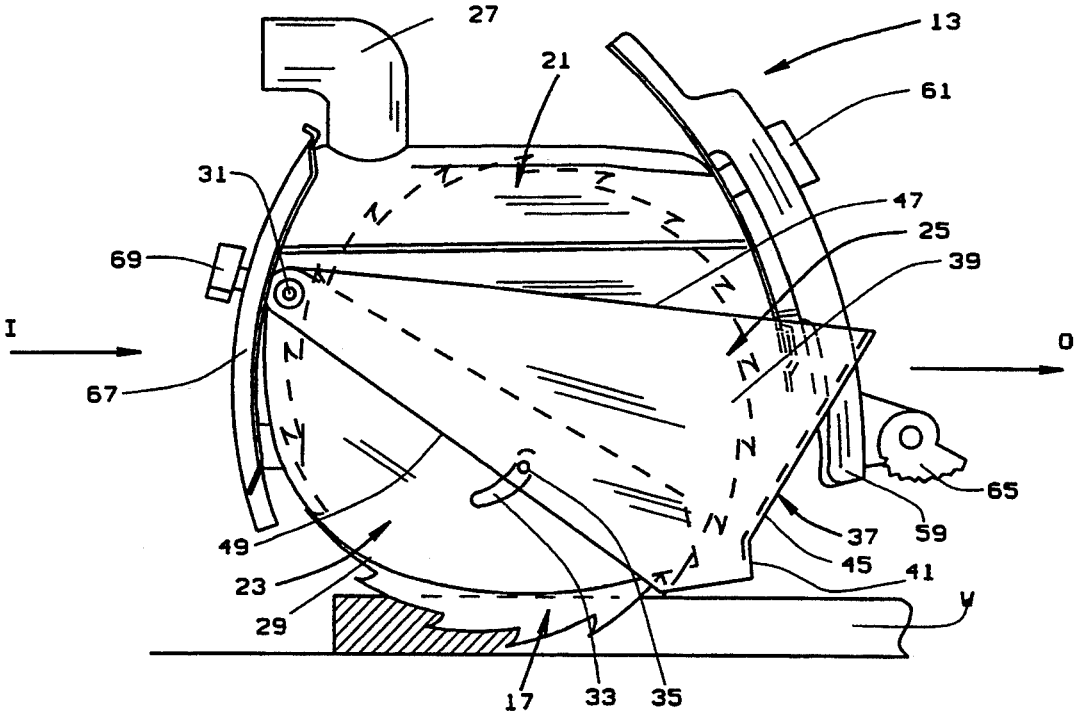
FIG. 13 is a side elevational view of the radial saw assembly during a cross cutting operation and illustrating the manner in which the lower front and rear guards are moved upwardly along with adjustable infeed and outfeed user barriers, for the cross cutting operation.

The independently and jointly operable lower and rear blade guards 23, 25, respectively, have several important functions with respect to one another and to the upper blade guard 21. The potential for hand contact with the sides of the blade 17 during rip cutting is substantially minimized, due to the manner in which the lower front blade guard 23 rides on the surface of a workpiece, while the lower rear blade guard 25 substantially covers the blade tip ends throughout the rip cutting operation, thus helping to prevent hand contact with the out-feed side of the blade 17. With the transverse blunt wall 41 and the offset pivotal axis mounting of the lower rear blade guard 25 to the upper blade guard 21 at the pivot axis 31, the lower rear blade guard 25 prevents wrong way feeding during rip cutting operations. By using lower front blade guards 23 in the form of side plates on each side of the motor driven saw blade 17, careless hand contact with the motor driven saw blade, throughout a substantial peripheral extent will be prevented. The lower rear blade guard 25 further partially blocks hand contact with the motor driven saw blade 17 when lowered to a workpiece surface during cross cutting operations, as shown in FIG. 13 of the drawings. It also prevents carriage and blade roll forward past a worktable mounted fence 15 when set up for cross cuts, where the worktable supported fence 15 is in front of the lower rear blade guard 25, as shown in FIG. 4 of the drawings. The combined lower front blade guard 23, lower rear blade guard 25 and upper fixed blade guard 21 further cooperate to contain sawdust and workpiece fragments, for additional operational efficiency and user safety.

Figure 14:
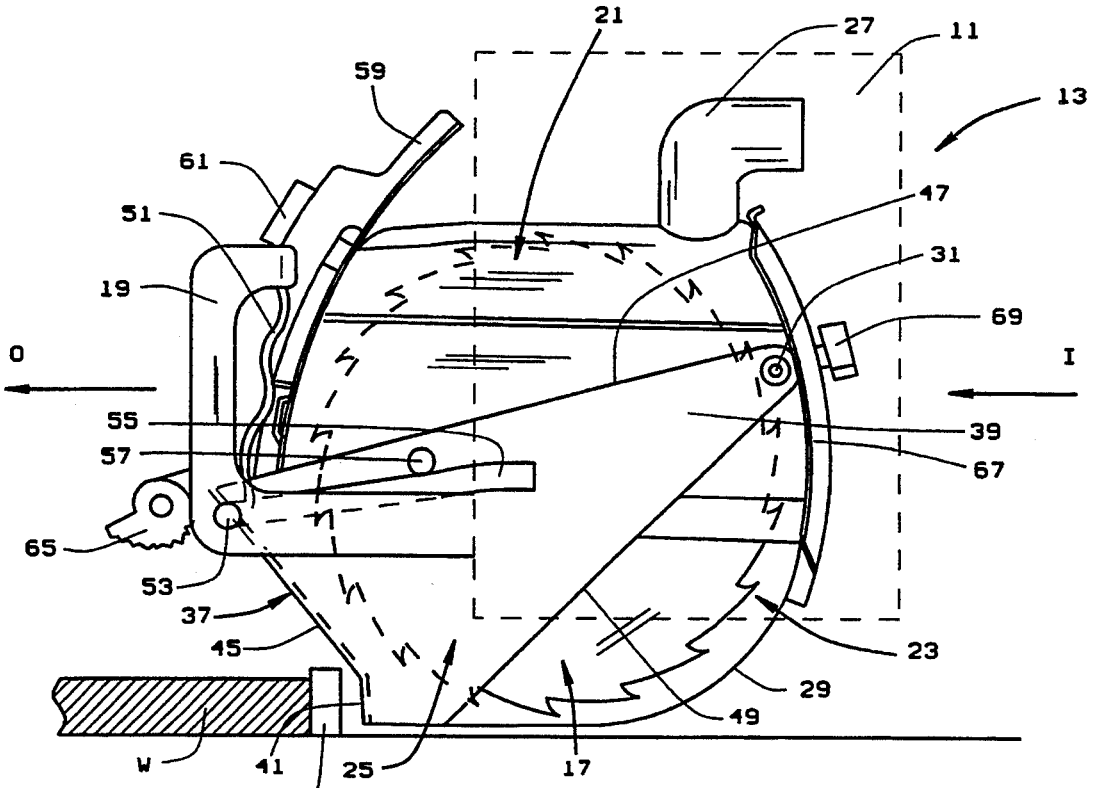
FIG. 14 is an enlarged side elevational view of the radial saw assembly, just prior to a cross cutting operation, and illustrating the need for raising the lower front and rear blade guards, prior to the cross cutting operation.
Figure 15:
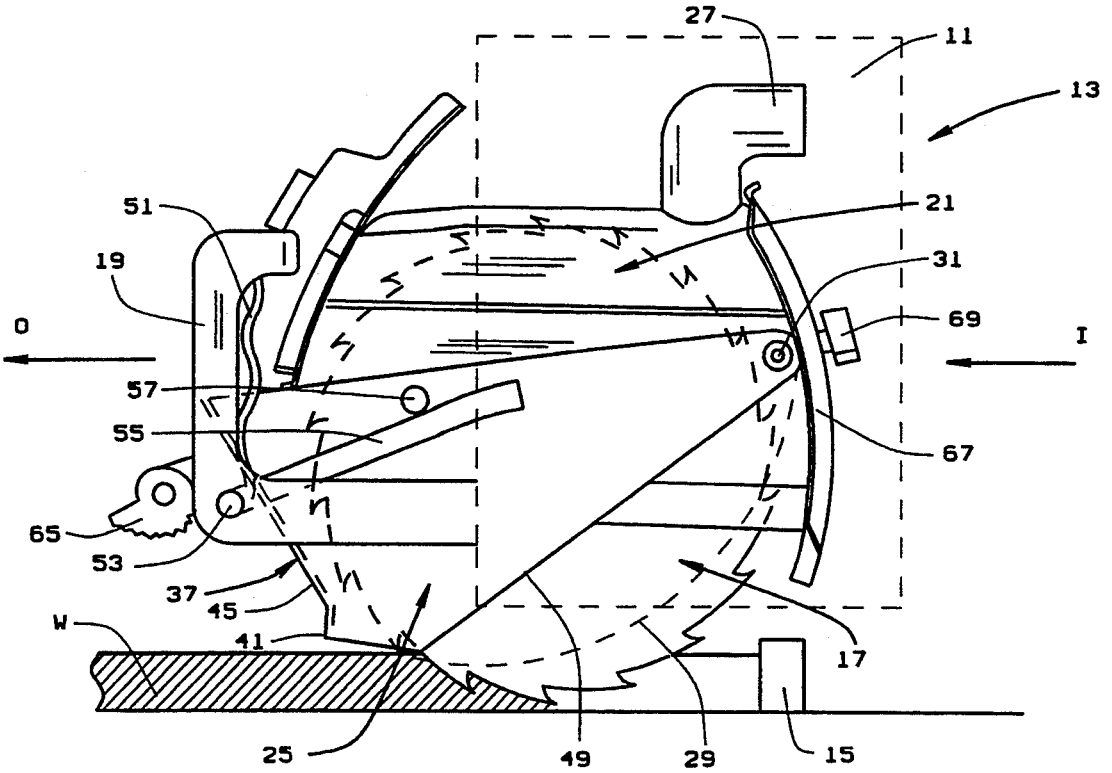
FIG. 15 is an enlarged side elevational view of the radial saw assembly illustrating the operation of a trigger means in raising the lower rear and front blade guards, in order to permit a cross cutting operation.

In addition to rip cutting operations as shown in FIGS. 8–12 of the drawings, FIGS. 13–15 show cross cutting operations. FIG. 13 specifically shows the manner in which the lower rear blade guard 25 is lifted adore a workpiece W, for also lifting the lower front blade guard 23 through the complementary slot and pin connection 33, 35, respectively, in order to perform a cross cut with the radial saw assembly 13. It will be apparent that the pin 35 of the lower rear blade guard 25 will engage an upper edge of the curvilinear slot 33, in order to lift the lower front blade guard 23, as the lower rear blade guard 25 is lifted.

FIGS. 14–15 show a suitable trigger mechanism associated with the handle 19 for lifting the lower rear blade guard 25 and lower front blade guard 23. The handle 19 is mounted to the yoke 11, as best seen in FIG. 1 of the drawings. In FIGS. 14–15, the yoke 11 is shown in phantom lines, with the handle 19 schematically illustrated as being mounted to the phantom line yoke 11. A trigger 51 is pivotally mounted at 53 for moving a ramp element 55 relative to a roller 57 that is attached to the triangular side plate 39 of the U-shaped lower rear guard 25 on the side adjacent the motor (not shown). In this regard, it will be apparent that FIGS. 14–15 show an opposite side of the radial saw assembly 13 from that illustrated in FIGS. 8–13.

As the trigger 51 is depressed from the position shown in FIG. 14 to that illustrated in FIG. 15, the ramp 55 will pivot about the axis 53 and cause the upper surface of the ramp to engage the roller 57 for moving the lower rear blade guard 25 from a lower position shown in FIG. 14 to an upper position as illustrated in FIG. 15. Following lifting of the lower rear blade guard 25, and the lower front blade guard 23 as previously explained, it is possible to lift the lower rear blade guard 25 and lower front blade guard 23 up and over the worktable supported fence 15, in order to begin cross cutting operations. The trigger mechanism 51 enables the lower rear blade guard 25 and lower front blade guard 23 to be moved up and over the worktable mounted fence 15 and workpiece W, but allows the lower rear blade guard 25 and the lower front blade guard to return automatically to the down position when the radial saw assembly 13 is positioned behind the worktable mounted fence 15 after the cross cutting operation. As will be apparent, the lower rear blade guard 25, together with the lower front blade guard 23, also protect the user against hand contact with the motor driven saw blade during a cross cutting operation, as illustrated in FIGS. 13 and 15 of the drawings.

Figure 7:
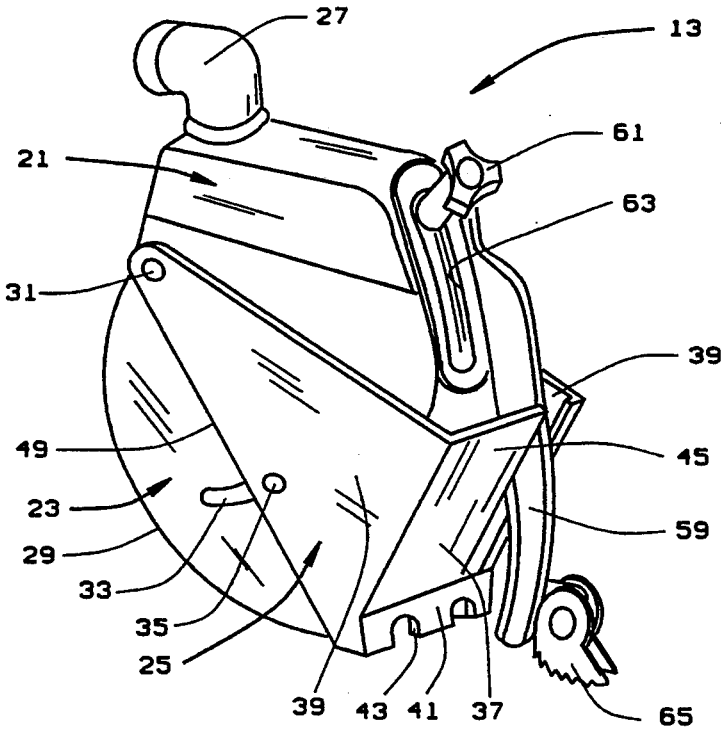
FIG. 7 is an enlarged perspective view of the radial saw assembly including independently operable saw guards, as viewed from the outfeed side of the radial saw when set up for a rip cutting operation.

Additional safety and operational features depend from the upper blade guard 21 to facilitate rip cutting and cross cutting operations. An adjustable outfeed user barrier in the form of a riving knife 59 is adjustably mounted to the upper blade guard 21 through a hand knob 61 that extends through an elongated slot 63 in the riving knife 61 and is threadably mounted to the upper blade guard 21,, as best seen in FIG. 7 of the drawings. At the lower end of the riving knife, anti-kickback pawls 65, 65 are arranged to engage a workpiece on opposite sides of the workpiece kerf K during a rip cutting operation. This is best seen in FIG. 11 of the drawings where the riving knife 59 and anti-kickback pawls 65, 65 are positioned within and on opposite sides of the workpiece kerf K. The riving knife 59 holds the workpiece kerf K open to prevent workpiece kickbacks, while helping guide the workpiece W. In addition, it prevents wrong way feeding during rip cuts, by extending directly within the path of a workpiece W attempted to be fed through the outfeed side O of the radial saw assembly 13. It also blocks hand contact with the outfeed side O of the motor driven saw blade 17 during rip cuts, by keeping a user's hand from the motor driven saw blade 17. The riving knife 59 also partially blocks hand contact with the motor driven saw blade 17, when lowered to just above the workpiece surface, during cross cutting operations.

The anti-kickback pawls 65, 65 are adjustably mounted to ride on the surface of the workpiece W during rip cutting operations. Specifically, the anti-kickback pawls 65, 65, have a number of important functions, they not only restrain the workpiece W in the event of a kickback, but partially block contact with the outfeed side O of the motor driven saw blade 17 during rip cutting. They also partially block hand contact with the motor driven saw blade 17 when lowered to just above the workpiece W during cross cutting operations.

On the infeed side I of the radial saw assembly 13 during rip cutting operations, as shown in FIGS. 8–12 of the drawings, a hold down 67 is employed for holding workpieces close to the worktable 3 at the infeed side I of the radial saw assembly 13 during rip cutting. The curvilinear shaped hold down 67 cooperates with hand knob 69 that extends through an elongated slot 71 in the hold down 67, the hand knob 69 being threadably mounted directly to the upper blade guard 21. The purpose of the hold down 67 is to keep a workpiece W from raising off the surface of the worktable 3 on the infeed side I of the motor driven saw blade 17 during rip cuts, as best seen in FIG. 11 of the drawings. The hold down 67 also partially blocks hand contact with the infeed side I of the motor driven saw blade 17 during rip cuts. Additionally, the curved shape of the hold down 67 also assists in directing saw dust up into the fixed upper blade guard 21, toward the saw dust outlet 27.

From the foregoing, it will now be appreciated that the independently and jointly operable radial arm saw guards in the radial saw of the present invention eliminate numerous safety hazards, while enhancing the operational efficiency of a radial saw during rip cutting and cross cutting operations. Because radial saws are operated in fixed and moving relationship in two different directions for rip cutting and cross cutting, the independently and jointly operable radial saw guards have been constructed to provide independent and joint operation, to accomplish specific purposes as explained above, in both rip cutting and cross cutting operations.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

I claim:

1. A radial saw for rip cutting and cross cutting workpieces comprising:

a motor driven saw blade mounted on a yoke depending from a supporting arm that overhangs a worktable, said motor driven saw blade being movable relative to a worktable mounted fence to enable said motor driven saw blade to be operated for rip cutting workpieces longitudinally relative to the fence and for cross cutting transverse relative to the fence;

an upper blade guard mounted in fixed position relative to said yoke mounted motor driven saw blade for covering at least approximately an upper half of the motor driven saw blade;

a lower rear blade guard pivotally mounted to the upper blade guard and configured to cover a lower half rear area on at least one side of the motor driven saw blade;

a lower front blade guard independently pivotally mounted to the upper blade guard and configured to cover a lower half front area on at least one side of the motor driven saw blade guard; and said lower rear blade guard including a wrong way feed barrier during rip cutting.

2. The radial saw as defined in claim 1 wherein the lower rear blade guard and lower front blade guard are telescopically movable with respect to one another to provide substantial protection to a user through limited exposure to said motor driven saw blade.

3. The radial saw as defined in claim 2 wherein the lower rear blade guard is also telescopically movable relative to the upper blade guard when the lower rear blade guard is lifted at the start of cross cutting or for rip cutting.

4. The radial saw as defined in claim 3 wherein the lower rear blade guard and lower front blade guard have a joint pivotal mounting to the upper blade guard and include cooperating complementary pin and slot means spaced from the joint pivotal mounting of said lower rear blade guard and lower front blade guard to assist in telescopic movement with respect to one another.

5. The radial saw as defined in claim 4 wherein the lower rear blade guard is a U-shaped element that extends on opposite sides of and across an outfeed end of said motor driven saw blade.

6. The radial saw as defined in claim 5 wherein said lower front blade guard comprises a flat plate section on one side of the motor driven saw blade.

7. The radial saw as defined in claim 6 wherein said lower front blade guard comprises a pair of opposed flat plate sections mounted on opposite sides of said motor driven saw blade.

8. The radial saw as defined in claim 1 wherein the wrong way feed barrier includes a blunt transverse wall along an outfeed end of the lower rear blade guard to provide the wrong way feed barrier during rip cutting.

9. The radial saw as defined in claim 8 wherein the lower rear blade guard includes an angular wall section that extends upwardly and outwardly from the blunt transverse wall and terminates in an inclined upper wall section that overlies the upper blade guard.

10. The radial saw as defined in claim 9 and including means for lifting the lower rear blade guard relative to the upper blade guard at the start of cross cutting.

11. The radial saw as defined in claim 10 wherein the means to raise the lower rear blade guard includes hand operated trigger means connected to the lower rear blade guard for raising same.

12. The radial saw as defined in claim 8 wherein the lower front blade guard includes a curved shape along an infeed end which cooperates with the joint pivotal and telescopic mounting of the lower rear blade guard and lower front blade guard to each other to facilitate automatic upward or downward movement of the lower front blade guard upon engaging or disengaging a workpiece.

13. A radial saw for rip cutting and cross cutting workpieces comprising:

a motor driven saw blade mounted on a yoke depends from a supporting arm that overhangs a worktable, said motor driven saw blade being movable relative to a worktable mounted fence to enable said motor driven saw blade to be operated for rip cutting workpieces longitudinally relative to the fence and for cross cutting transverse relative to the fence;

an upper blade guard mounted in fixed position relative to said yoke mounted motor driven saw blade for covering at least approximately an upper half of the motor driven saw blade;

a lower rear blade guard pivotally mounted to the upper blade guard and configured to cover a lower half rear area of the motor driven saw blade, said lower blade guard including a wrong way feed barrier during rip cutting;

a lower front blade guard independently and pivotally mounted to the upper blade guard and configured to cover a lower half front area on at least one side of the motor driven saw blade, said lower front blade guard including automatic lifting means to facilitate upward or downward movement relative to lower rear guard and the upper blade guard upon engaging or disengaging a workpiece;

said lower rear blade guard and said lower front blade guard being telescopically movable with respect to one another to provide substantial protection to a user through limited exposure of said motor driven saw blade during rip cutting;

said lower rear blade guard and said upper blade guard being telescopically movable with respect to one another when the lower rear blade guard is lifted during cross cutting; and said lower rear blade guard includes a blunt transverse wall at an outfeed end which serves as the wrong way feed barrier during rip cutting.

14. The radial saw as defined in claim 13 wherein the lower rear blade guard is a U-shaped element having the blunt transverse wall and an upper angular wall section forming a bight end portion of the U-shaped element which cover blade tip ends of the motor driven saw blade, and generally parallel and opposed triangular shaped side plates extending from the bight end portion for covering opposite sides of the motor driven saw blade, the triangular shaped side plates of the U-shaped lower rear blade guard being pivotally mounted to the upper blade guard at a location spaced from the bight end portion of the U-shaped lower rear blade guard.

15. The radial saw as defined in claim 14 wherein the lower front blade guard comprises a pair of flat plate sections on opposite sides of the motor driven saw blade which are pivotally mounted on the upper blade guard, each of said flat plate sections having a curved shaped along an infeed end which cooperates with the joint pivotal mounting of the lower rear blade guard and lower front blade guard to facilitate automatic upward or downward movement of the flat plate sections relative to the lower rear blade guard and upper blade guard upon engaging or disengaging a workpiece.

16. The radial saw as defined in claim 15 and further including cooperating complementary pin and slot means between the flat plate sections of the lower front blade guard and the generally triangularly shaped sections of the lower rear blade guard to facilitate telescopic movement of the lower front blade guard and lower rear blade guard relative to each other.

17. A radial saw for rip cutting and cross cutting workpieces comprising:

a motor driven saw blade mounted on a yoke depends from a supporting arm that overhangs a worktable, said motor driven saw blade being movable relative to a worktable mounted fence to enable said motor driven saw blade to be operated for rip cutting workpieces longitudinally relative to the fence and for cross cutting transverse relative to the fence;

an upper blade guard mounted in fixed position relative to said yoke mounted motor driven saw blade for covering at least approximately an upper half of the motor driven saw blade;

a lower rear blade guard pivotally mounted to the upper blade guard and configured to cover a lower half rear area of the motor driven saw blade;

a lower front blade guard independently and pivotally mounted to the upper blade guard and configured to cover a lower half front area of the motor driven saw blade;

said lower rear blade guard and said lower front blade guard being telescopically movable with respect to one another to provide substantial protection to a user through limited exposure of said motor driven saw blade during rip cutting;

said lower rear blade guard and said upper blade guard being telescopically movable with respect to one another when the lower rear blade guard is lifted during cross cutting;

said lower rear blade guard and said lower front blade guard being provided on at least one side of said motor driven saw blade; and said lower rear blade guard including a blunt transverse wall at an outfeed end which serves as wrong way feed barrier means during rip cutting.

18. The radial saw as defined in claim 17 wherein said lower rear blade guard and said lower front blade guard are provided on both sides of said motor driven saw blade.

* * * * *